US008677575B1

(12) United States Patent
Bergstrom

(10) Patent No.: US 8,677,575 B1
(45) Date of Patent: Mar. 25, 2014

(54) JEWELRY CLASP

(76) Inventor: Jenny Bergstrom, Los Angeles, CA (US)

( * ) Notice: Subject to any disclaimer, the term of this patent is extended or adjusted under 35 U.S.C. 154(b) by 28 days.

(21) Appl. No.: 13/285,950

(22) Filed: Oct. 31, 2011

Related U.S. Application Data

(60) Provisional application No. 61/408,212, filed on Oct. 29, 2010.

(51) Int. Cl.
*A44C 5/00* (2006.01)
*A44B 99/00* (2010.01)

(52) U.S. Cl.
USPC ..... 24/616; 24/615; 24/627; 24/634

(58) Field of Classification Search
USPC ..... 63/3.1; 24/574.1, 587.11, 614, 615, 24/616, 625, 627, 634
See application file for complete search history.

(56) References Cited

U.S. PATENT DOCUMENTS 3,430,306 A * 3/1969 Tareau ..... 24/593.1
5,971,119 A * 10/1999 Chi ..... 190/108
7,515,053 B2 * 4/2009 Klein ..... 340/572.8

* cited by examiner

*Primary Examiner* — Victor Batson
*Assistant Examiner* — Abigail Morrell
(74) *Attorney, Agent, or Firm* — Patent Law Offices of Michael E. Woods; Michael E. Woods

(57) ABSTRACT

A clasp for jewelry has a female member and a male member insertable into the female member. Upon insertion, a plurality of engagements can be formed between the male and female members, such that two hands of a user can be required to disengage the male member from the female member. A satellite positioning system can be contained therein the female member so that the location of a wearer of the clasp can be determined.

3 Claims, 6 Drawing Sheets

JEWELRY CLASP

CROSS REFERENCE TO RELATED APPLICATIONS

This application claims the benefit of U.S. Provisional Application No. 61/408,212, filed 29 Oct. 2010.

BACKGROUND OF THE INVENTION

This invention relates generally to jewelry, and more specifically but not exclusively, to jewelry in general, clasps in particular, including a clasp requiring the use of two hands to remove.

Much conventional jewelry includes clasps and other retaining systems for maintaining the jewelry closed and secured to the person. A particular class of jewelry, for example a bracelet and the like designed to be attached to a wrist, can be sized so that attachment to, and removal from, the person requires operation of the clasp. These conventional clasp systems are designed so that the wearer can operate the clasp with a single hand as the user will have but the one hand available.

There are various diseases, syndromes, conditions that are known to cause serious loss of cognitive ability. When associated with a mature person, this loss is often referred to in general as dementia. For example, Alzheimer's disease is a common form of dementia. Persons suffering from Alzheimer's disease exhibit a wide range of symptoms, including difficulty in remembering recent events. Other symptoms can include confusion, trouble with language, and long-term memory loss.

Because Alzheimer's disease cannot be cured and is degenerative, the sufferer must rely on others for assistance. It is the case that sufferers can be very capable physically; and in some cases they can remove themselves from caregiver environments established specifically to provide care and security, and put themselves in unfamiliar environments. In these unfamiliar environments, it can be the case that the sufferer's lack of complete cognitive function puts them at risk and unable to participate in relocating them to the preferred caregiver environment.

Traditional identification for these sufferers can be unreliable because it is the case that the sufferer may completely discard all identifying information. This is particularly true for identification systems (ID cards, conventional ID bracelets and necklaces, and the like) that can be removed without much effort and/or without complete cognitive function.

There is another class of individuals that can relocate themselves from caregiver environments and find themselves in unfamiliar environments and be unable to offer much assistance in being returned to the preferred caregiver environment. This class includes young children and persons with certain types of learning and cognitive disabilities. These individuals can also have enough physical motor control to remove and discard conventional identification systems.

Identification systems can have undesirable connotations, particularly when associated with an adult. Identification systems that are worn and semi-permanently associated with a person are desirably manufactured to be discrete and ornamental. However they cannot be so discrete as to be "hidden in plain sight" such as when a rescuer observes the identification object but fails to realize its import and thus does not make use of the object for its intended use.

What is needed is an identification system and method that may be removeably semi-permanently associated with a person that is effective and may be ornamental.

BRIEF SUMMARY OF THE INVENTION

Disclosed is an identification system and method that may be removeably semi-permanently associated with a person that is effective and may be ornamental. The present invention includes embodiments directed towards engagement systems that include multiple independent engagement systems, each of which must be operated substantially simultaneously or concurrently in order to remove the piece of jewelry incorporating the engagements systems.

A closure system for a removeably semi-permanently associatable jewelry object to be worn by a wearer, including a housing, coupled to the removeably semi-permanently associatable jewelry object, having a pair of independently-operable engagement systems; and a member, coupled to the removeably semi-permanently associatable jewelry object, having a pair of engagement structures engageable with the pair of independently-operable engagement systems wherein the member includes a closed mode in which the pair of engagement structures engage the pair of independently-operable engagement systems wherein the removeably semi-permanently associatable jewelry object may not be disassociated from the wearer, and wherein the member further includes an open mode in which the pair of engagement structures are disengaged from the pair of independently-operable engagement systems and the removeably semi-permanently associatable jewelry object may be disassociated from the wearer; wherein the member may not be transitioned from the closed mode to the open mode without one hand operating one of the pair of independently-operable engagement systems and another hand operating a different one of the pair of independently-operable engagement systems.

A method for releasably closing a jewelry object includes the steps of: a) engaging an interlocking member of the jewelry object with a housing of the jewelry object to transition the interlocking member to a closed mode from an open mode; and b) maintaining the interlocking member in the closed mode until at least two independently-operable engagement systems securing the interlocking member to the housing are actuated to allow the interlocking member to be disengaged and transitioned from the closed mode to the open mode.

Features/benefits include an ability to inhibit removal of an object, such as a jewelry object, from a wearer by requiring multiple coordinated actuations of independent engagements systems before the object may be removed. When incorporated into a bracelet, particularly a medical alert or informational bracelet, the wearer and caregiver's of the wearer may have increased confidence that the bracelet will not be removed unintentionally.

Other features, benefits, and advantages of the present invention will be apparent upon a review of the present disclosure, including the specification, drawings, and claims.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

Embodiments of the present invention provide an apparatus and method providing an identification system and method that may be removeably semi-permanently associated with a person that is effective and may be ornamental. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein. The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to a "clasp" can include two or more such clasps unless the context indicates otherwise.

Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Reference will now be made in detail to the present preferred embodiment(s) of the invention, examples of which are illustrated in the accompanying drawings. Wherever possible, the same reference numbers are used throughout the drawings to refer to the same or like parts.

Figure 1:
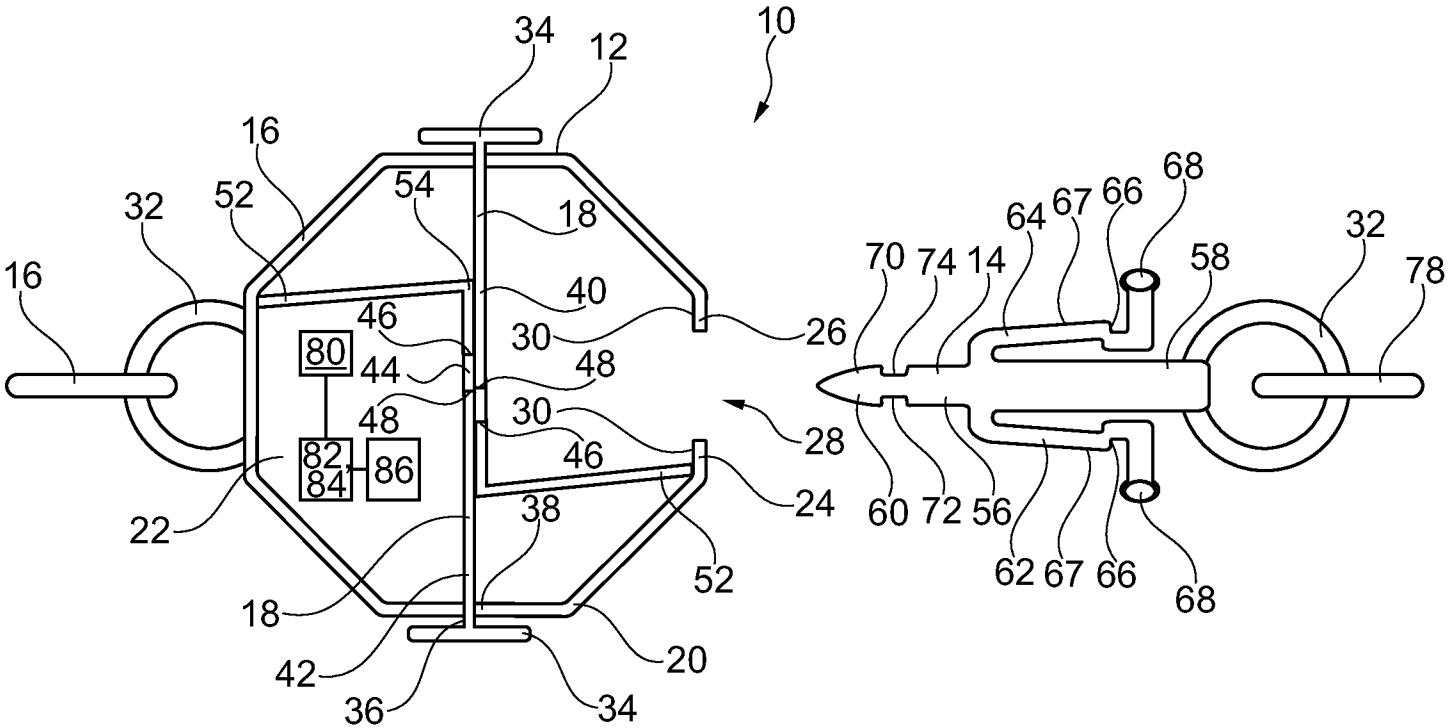
FIG. 1 is a plan view of, according to one aspect, of a jewelry clasp comprising a female member and a male member that is selectively, releasably insertable into the female member, the female member is shown with its outer cover removed for viewing of the components of the female member within the interior chamber of the female member.

According to various embodiments, and as illustrated in FIG. 1, a jewelry clasp 10 is provided. In one aspect, clasp 10 includes a female member 12 and a male member 14 that is selectively, releasably insertable into female member 12.

In another aspect, the female member 12 comprises a housing 16 having a sidewall 20 that defines an interior chamber 22. In one aspect, housing 16 can be substantially octagonal in shape; however other shapes, such as substantially square, circular, rectangular, pentagonal, polygonal, and the like are contemplated. In one aspect, housing 16 can have a cross-sectional area of about 1 mm2, about 2 mm2, about 3 mm2, about 4 mm2, about 5 mm2, about 7.5 mm2, about 10 mm2, about 12.5 mm2, about 15 mm2, about 17.5 mm2, about 20 mm2, about 22.5 mm2, about 25 mm2, about 27.5 mm2, about 30 mm2, about 35 mm2, about 40 mm2, about 45 mm2, about 50 mm2, about 60 mm2, about 70 mm2, about 80 mm2, about 90 mm2, about 100 mm2, or greater than 100 mm2. In another aspect, housing 16 includes a cover 55, described more fully below, having a combined thickness of about 0.5 mm, about 1 mm, about 1.5 mm, about 2 mm, about 2.5 mm, about 3 mm, about 4 mm, about 5 mm, about 6 mm, about 7 mm, about 8 mm, about 9 mm, about 10 mm, or greater than about 10 mm.

In another aspect, sidewall 20 has a first end 24 and a second end 26, and defines a slot 28 between the ends of sidewall 20 configured for receiving a portion of male member 14. In another aspect, first end 24 and second end 26 of sidewall 20 each comprise a ledge 30 configured to matingly engage a portion of male member 14, as described more fully below. A connecting member 32, such as an annular ring, slot, aperture or the like, is fixedly attached to a portion of sidewall 20 on a side of housing 16 opposed to slot 28.

Female member 12 further comprises a plurality of legs 18. According to one aspect, each leg 18 has a foot 34 positioned outside of interior chamber 22 of housing 16. In another aspect, a first end 36 of each leg 18 can be coupled to a corresponding foot 34, and a portion of each leg 18 extends through a channel 38 defined in sidewall 20 into interior chamber 22. In yet another aspect, at least a portion of each leg 18 is positioned inside interior chamber 22 of housing 16 substantially parallel to slot 28 defined in sidewall 20. In still another aspect, the plurality of legs 18 comprise a first leg 40 and a second leg 42, wherein at least a portion of the first and second legs are positioned inside interior chamber 22 of housing 16 substantially parallel to each other and to slot 28 defined in sidewall 20. In another aspect, the foot 34 of the first and second legs 40, 42 can be positioned on opposed sides of housing 16.

In one aspect, a groove 44 or aperture is defined in a portion of each leg, groove 44 configured for matingly engaging a portion of the male member 14, as described more fully below. Groove 44 includes a groove width of predetermined distance. In one aspect, groove 44 has a first side 46 and a second side 48 substantially perpendicular to an upper surface of each leg 18. In another aspect, the first and/or the second side 46, 48 can be at an acute angle relative to the upper surface of each respective leg.

According to one aspect, legs 18 are selectively movable between a first relaxed position in which the foot 34 of each leg is a first distance from sidewall 20 of housing 16, and a second position in which the foot of each leg is a second distance from sidewall 20 of housing 16 that is greater than the first distance. In another aspect, legs 18 include a biasing mechanism biasing the legs from the second position to the first position. For example, in one aspect and as illustrated in FIG. 1, legs 18 have a second end 52 positioned in contact with sidewall 20 of housing 16. An angle or bend 54 is formed in legs 18 such that the bend urges each respective leg to the first position. In another example, the legs include a spring or other biasing device.

Figure 3:
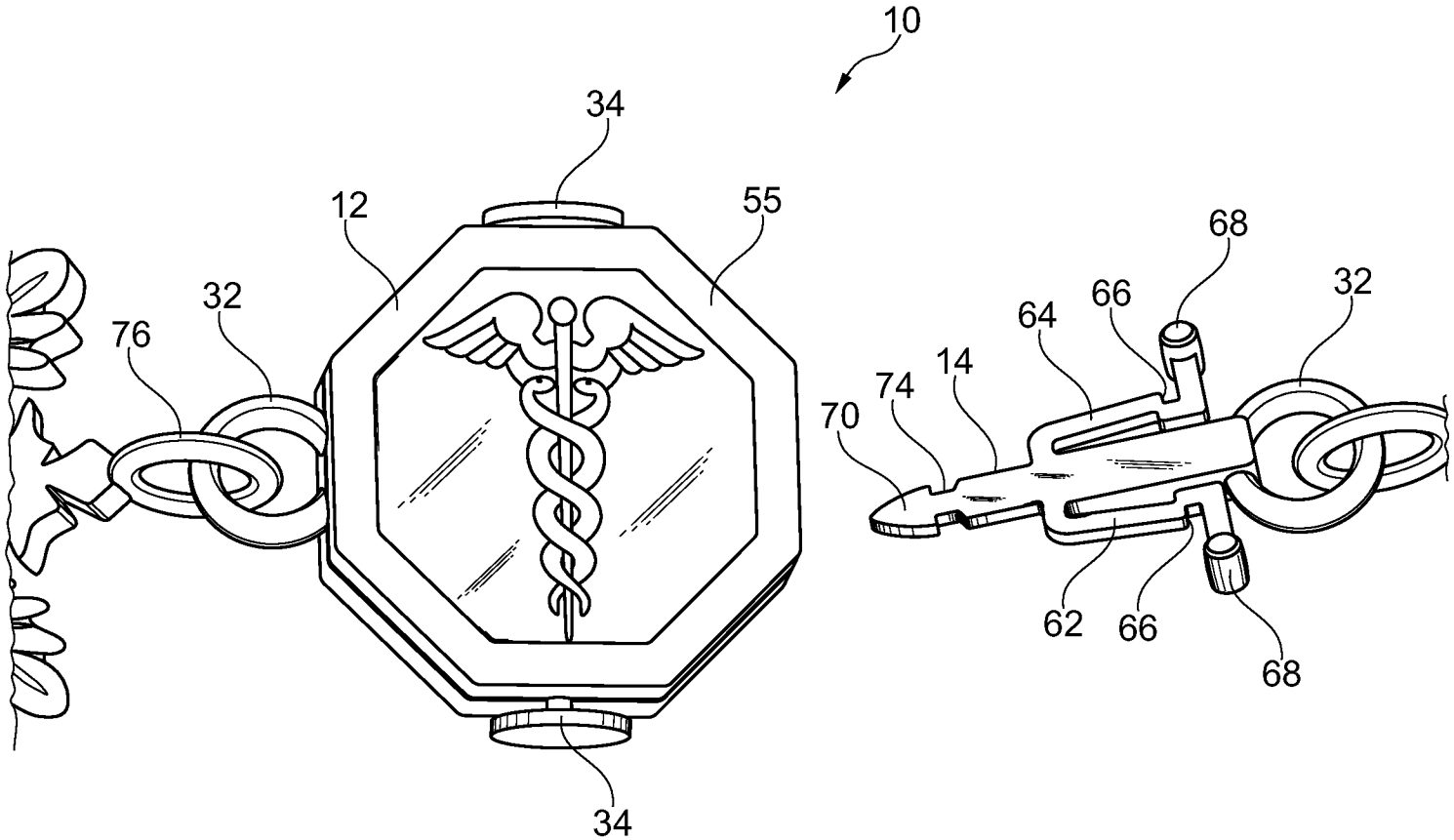
FIG. 3 is a plan view of a jewelry clasp of FIG. 1, showing the female member with its outer cover in position, according to one aspect.

As illustrated in FIG. 3, female member 12 includes cover 55 configured to enclose interior chamber 22 of housing 16. In one aspect, cover 55 and/or housing 16 can display a symbol, such as, for example, and without limitation, a medic alert symbol, caduceus, or the like. In another aspect, cover 55 and/or housing 16, or a portion thereof, are colored a color, such as for example and without limitation, red, to attract attention to clasp 10. In another aspect, cover 55 and/or housing 16 include medical information, for example including identification and the like, printed thereon in order to provide a caregiver with information about the wearer of the clasp 10. In still another aspect, housing 16 and cover 55 matingly engage each other to form a substantially waterproof/water resistant seal (for example, clasp 10 could be worn in a shower or while swimming without permitting water to enter interior chamber 22 of housing 16).

Referring again to FIG. 1, in one aspect, male member 14 comprises a central body 56 having a longitudinal axis, a proximal end 58, and a distal end 60, with a first arm 62 and an opposed second arm 64 protruding therefrom the central body. In another aspect, a connecting member 32, such as an annular ring, slot, aperture, or the like, is fixedly attached to a portion of proximal end 58 of male member 14.

In one aspect, a proximal shoulder 66 is formed on each arm 62, 64 of male member 14, each shoulder 66 configured for matingly engaging ledge 30 of the first and second ends 24, 26 of female member 12. In another aspect, proximal shoulder 66 of each arm 62, 64 is substantially perpendicular to the longitudinal axis of central body 56 of male member 14. In a further aspect, arms 62, 64 are each movable from a relaxed position, in which a distance from an outer surface 67 of first arm 62 to outer surface 67 of second arm 64 is greater than a width of slot 28 defined in sidewall 20 of housing 16, to a locked position, in which the distance from outer surface 67 of first arm 62 to outer surface 67 of second arm 64 is substantially equal to the width of slot 28, and a compressed position, in which the distance from outer surface 67 of the first arm 42 to outer surface 67 of second arm 64 is less than the width of slot 28. In a further aspect, a tab 68 extends from each arm 62, 64, tabs 68 configured for moving respective arms 62, 64 from the relaxed position to the locked position and/or the compressed position.

In one aspect, distal end 60 of male member 14 is formed into a head 70. In another aspect, head 70 is tapered in shape such that head 70 increases in width when moving in a direction from distal end 60 towards proximal end 58 of male member 14. In one aspect, head 70 increases in width to a maximum head width that is substantially the same width as the width of groove 44 defined in each of first and second legs 40, 42. Alternatively, the maximum head width may be less than the width of groove 44 defined in each of the first and second legs. A neck 72 is defined in male member 14 adjacent head 70, neck 72 having a neck width that is less than the maximum head width. In one aspect, a plurality of distal shoulders 74 are formed at the transition from head 70 of male member 14 to neck 72, distal shoulders 74 configured to matingly engage the plurality of legs 18 of female member 12 adjacent first side 46 of the groove of each leg. In another aspect, the width of neck 72 is substantially equal to the groove width of groove 44 of each leg 18 of female member 12. Alternatively, the width of neck 72 is less than width of groove 44.

In one aspect, female member 12 and/or male member 14 of clasp 10 is formed from conventional materials used for forming jewelry, such as gold, silver, aluminum and the like. In other aspect, at least portions of clasp 10 are formed from biocompatible materials, such as titanium, stainless steel, ceramics and the like.

In another aspect, clasp 10 further includes a mechanism for determining the geographical location of clasp 10, which can include in a preferred embodiment a satellite positioning system 80 that includes a receiver 82 adapted to receive satellite positioning signals. Satellite positioning system 80 includes a power source 86, such as a battery, and a conventional GPS transceiver 84 that assesses the GPS satellite network to determine a position of clasp 10 in latitude and longitude.

In order to assemble clasp 10, each leg 18 is positioned inside interior chamber 22 of housing 16 of female member 12 such that groove 44 of the leg is substantially parallel to slot 28 defined in sidewall 20 of the housing 16 and foot 34 of each leg is positioned outside of housing 16. In one aspect, second leg 42 is positioned such that foot 34 of the second leg is on an opposed side of housing 16 from foot 34 of first leg 40. Satellite positioning system 80 is activated and installed therein housing 16. Cover 55 is then securedly attached to housing 16 so that the plurality of legs 18 and satellite positioning system 80 are confined inside housing 16. A first end 76 of a piece of jewelry, such as a necklace, a bracelet, and the like may be fixedly attached to connecting member 32 of female member 12, and a second end 78 of the same piece of jewelry may be fixedly attached to connecting member 32 of male member 14.

Figure 2:
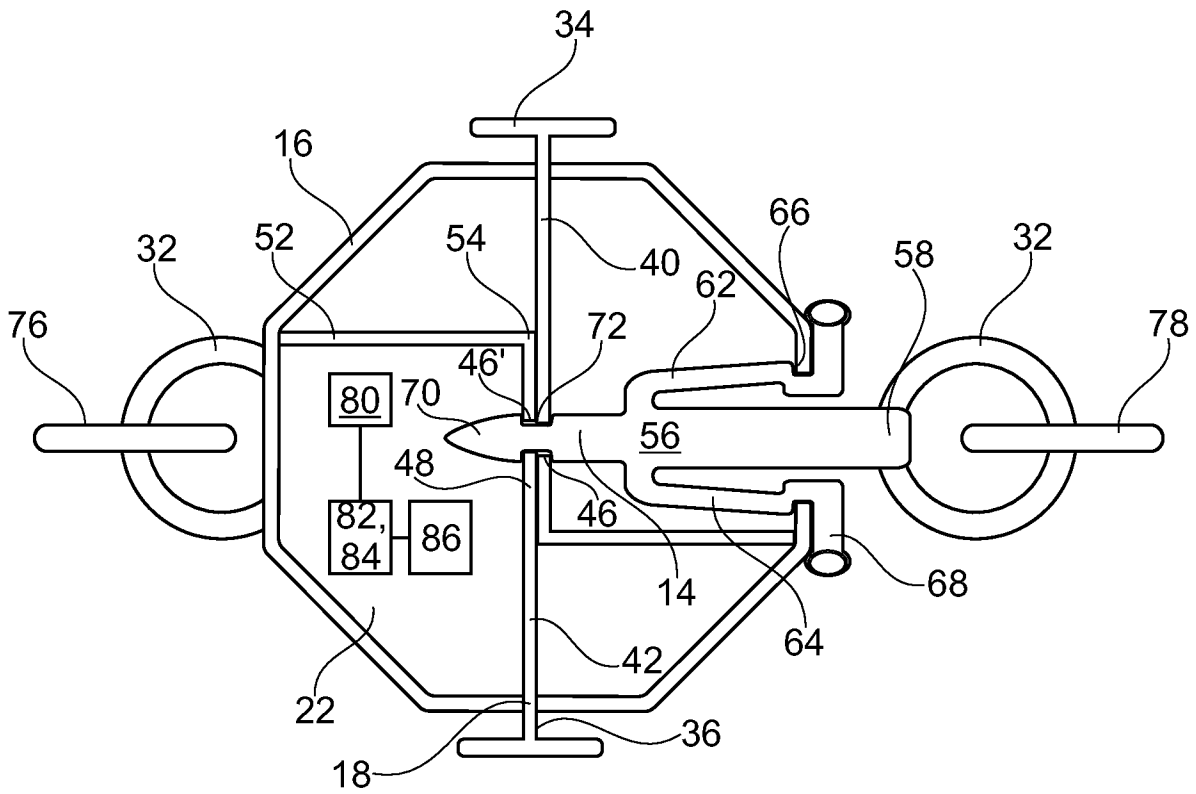
FIG. 2 is a plan view of the jewelry clasp of FIG. 1 in a clasped position, according to one aspect.

After clasp 10 has been assembled, clasp 10 may be used to removeably semi-permanently associate this piece of jewelry to a user. In use and with reference to FIG. 2, male member 14 is inserted into slot 28 of housing 16 of female member 12. In one aspect, head 70 of male member 14 contacts first side 46 of each leg 18 of the plurality of legs. As male member 14 is urged further into female member 12, the tapered shape of head 70 urge the legs from the first, relaxed position to the second, tensioned, position. In the second position, groove 44 of each respective leg can be aligned, such that the first and second sides 46, 48 of each groove 44 are substantially coplanar, and head 70 of male member 14 is inserted through the aligned grooves 44. When neck 72 is adjacent to groove 44 of the legs 18, the biasing mechanism of the legs from the second position toward the first position urges the legs to move from the second position toward the first position (such that the first and second sides 46, 48 of each groove 44 are not substantially coplanar), wherein distal shoulders 74 of head 70 matingly engage the plurality of legs 18 of female member 12 adjacent the first and/or second sides 46, 48 of groove 44 of each leg.

Substantially simultaneously, as male member 14 is inserted into slot 28 of housing 16, first end 24 of sidewall 20 contacts a portion of outer surface 67 of first arm 62 of male member 14, and second end 26 of sidewall 20 contact a portion of outer surface 67 of second arm 64 of male member 14. As male member 14 is urged further into female member 12, the first and second ends of sidewall 20 urge the arms from the relaxed position to the locked position when ledges 30 of sidewall 20 matingly engage proximal shoulders 66 formed on each arm. Tabs 68 of the arms prevent insertion of the male member into the housing beyond a predetermined distance.

After insertion of male member 14 into female member 12 the predetermined distance, ledge 30 of first and second ends 24, 26 of sidewall 20 matingly engage proximal shoulder 66 formed on each arm, and a portion of each leg 18 matingly engages distal shoulders 74 formed by neck 72 of male member 14. Thus in the preferred embodiment, there are two independent engagements between male member 14 and the female member 12 to prevent opening of clasp 10.

In order to open clasp 10, in one aspect, two hands are required. A first hand of the user urges foot 34 of each leg 18 of the plurality of legs toward the center of female member 12 so that the legs are urged to the second position. In the second position, groove 44 of each respective leg is aligned so that distal shoulders 74 of head 70 do not contact the legs, and head 70 of male member 14 is able to be removed from the aligned grooves 44. At the same time that foot 34 of each leg is being urged toward the center of female member 12, a second hand urges tab 68 of each arm 62, 64 toward the longitudinal axis of male member 14, thereby moving each arm from the locked position to the compressed position. In the compressed position, proximal shoulder 66 is disengaged from ledge 30 of the first and second ends 24, 26 of sidewall 20. Male member 14 may then be removed from slot 28 of female member 12 by sliding it substantially along its longitudinal axis in a direction away from female member 12.

In use, for example, a wearer's medical condition, prescription information, emergency contact phone number and the like can be inscribed on cover 55 and/or housing 16 of clasp 10 (e.g., a back surface) in a visible location. Satellite positioning system 80 can be activated by, for example inserting power source 86 into satellite positioning system 80. Clasp 10 may then be fixedly attached to a piece of jewelry such as a bracelet or other ornamental object disposed about the wrist of a wearer. The piece of jewelry may be removeably semi-permanently associated the wearer, such as around the wrist of the wearer, and clasp 10 is closed by inserting male member 14 into female member 12 until at least two engagements between the male and female members are formed. Semi-permanently refers to the extra effort of unassisted removal, particularly for a wearer having the object disposed about a wrist which allows the wearer to have a single free hand available for operating the disengagement systems.

After placing the piece of jewelry around the wrist of the wearer and closing clasp 10, because clasp 10 requires two available hands to open (and the bracelet/wrist jewelry removes one of the user's hands from availability), the wearer will not be able to remove the jewelry without assistance. Thus, for example, a caregiver of a wearer of the clasp having a disease such as Alzheimer's disease can track the location of the wearer with satellite positioning system 80 because the wearer will not be able to remove the jewelry unassisted. For systems without the satellite positioning system 80, the use of the medical alert/identification information removeably semi-permanently associated with the wearer provides other avenues for location and care for the wearer when the wearer is absent from the preferred caregiver environment.

Figure 4:
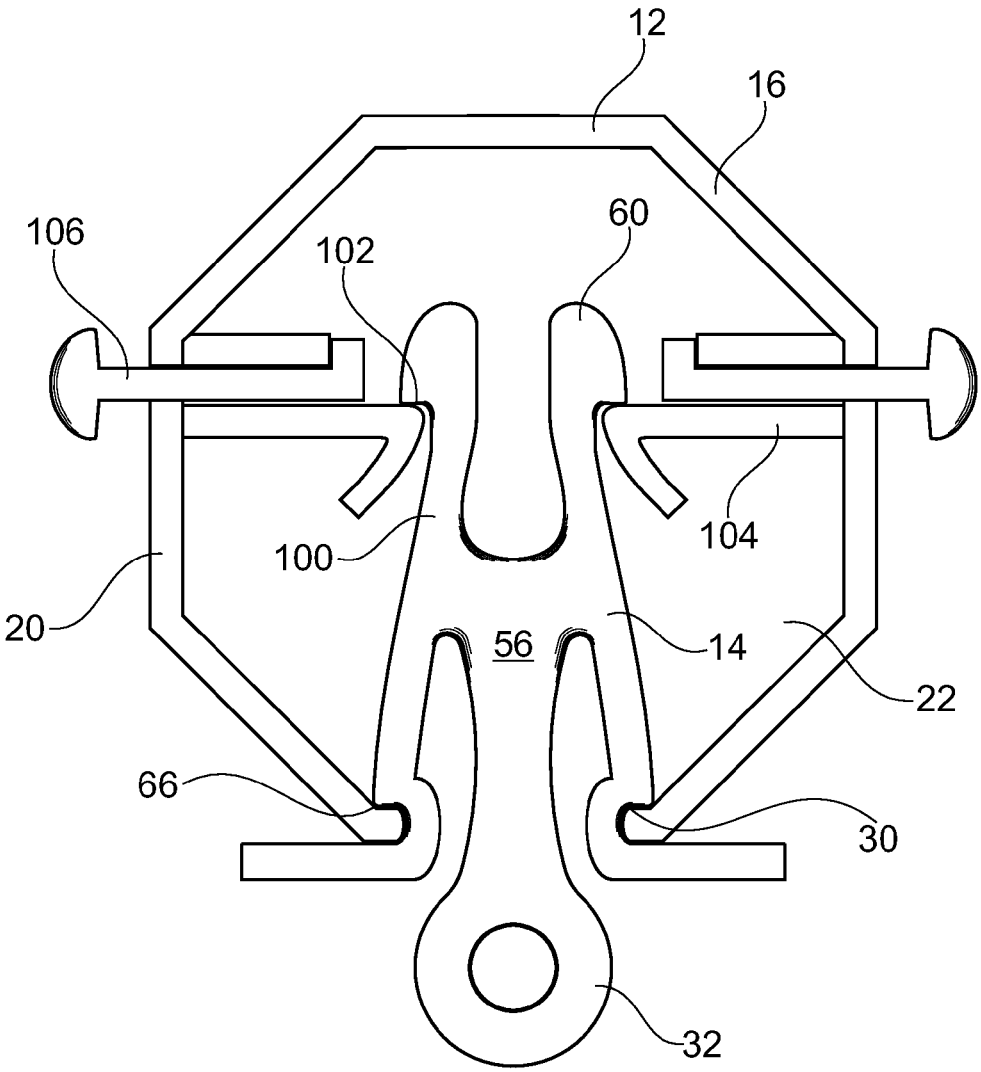
FIG. 4 is a plan view of, according to one aspect, a jewelry clasp comprising a female member and a male member that is selectively, releasably insertable into the female member, the female member is shown with its outer cover removed for viewing of the components of the female member within the interior chamber of the female member.

In another embodiment, and as illustrated in FIG. 4, distal end 60 of male member 14 includes a pair of distal shoulders 102. In one aspect, each of the distal shoulders 102 of male member 14 are formed on projections 100 extending from central body 56 of male member 14 such that distal shoulders 102 are selectively movable between a relaxed position, in which distal shoulders 102 are a first distance apart, and a compressed position in which distal shoulders 102 are a second distance apart that is less than the first distance.

In one aspect, female member 12 of this embodiment includes housing 16 as described above. In another aspect, however, instead of a plurality of legs being contained inside interior chamber 22 of housing 16, female member 12 further comprise at least one post 104 and at least one finger 106. In still another aspect, the at least one post 104 extends from sidewall 20 into interior chamber 22 of housing 16 and is configured to matingly engage the at least one distal shoulder 102 of male member 14. In yet another aspect, the at least one finger 106 also extends from sidewall 20 into interior chamber 22 and is selectively movable between a standard position, in which finger 106 extends a standard distance into interior chamber 22, and an inserted position, in which finger 106 extends an inserted distance into interior chamber 22 that is greater than the standard distance.

In use, to close clasp 10, male member 14 is inserted into slot 28 of housing 16 of female member 12. In one aspect, proximal shoulders 66 of male member 14 matingly engage ledge 30 at ends 24, 26 of sidewall 20. In another aspect, the at least one distal shoulder 102 matingly engages the at least one post 104. The engagement of shoulders 66, 102 of male member 14 to the ledges and the at least one post of female member 12 prevents simple opening of clasp 10.

In order to open clasp 10, in one aspect, two hands are again required. A first hand urges the at least one finger 106 from the standard position to the inserted position, thereby contacting the at least one distal shoulder 102 of male member 14 and moving it to the compressed position. In the compressed position, the at least one distal shoulder 102 can be disengaged from the at least one post 104. A second hand urges proximal shoulders 66 of male member 14 from the relaxed position to the compressed position, thereby disengaging shoulders 66 from ledges 30 of sidewall 20 by flexing proximal shoulders 66 toward each other. Male member 14 may then be removed from slot 28 of female member 12.

In still another embodiment, it is contemplated that at least a portion of clasp 10 may be implanted into a person. For example, the satellite positioning system 80 can be positioned therein interior chamber 22 of the housing 16. Sidewall 20 would be a continuous sidewall 20 without any slots or bores defined therein, and housing 16 would preferably be formed from a biocompatible material such as titanium, stainless steel, ceramics and the like. Cover 55 includes a biocompatible, waterproof cover that engages housing 16 to form a biocompatible, waterproof enclosure containing satellite positioning system 80.

Figure 5:
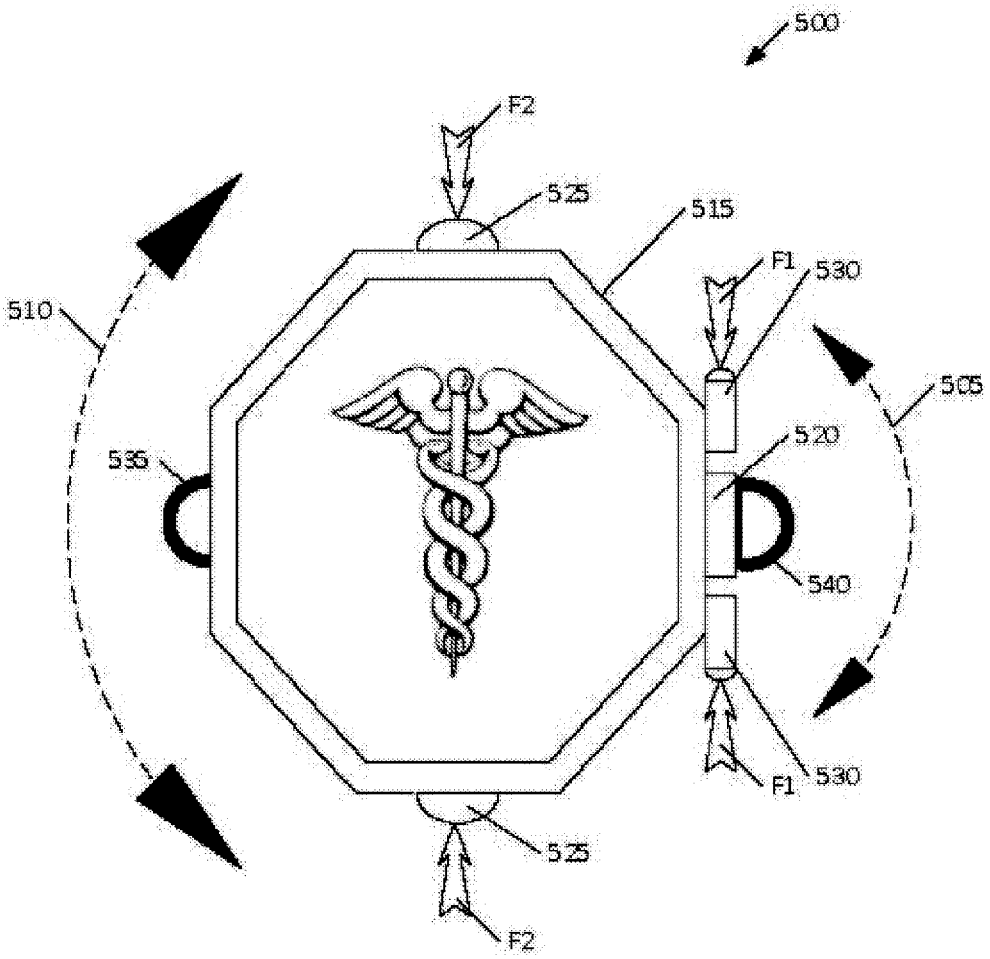
FIG. 5 illustrates a top view of a jewelry object having a pair of independently-operable engagement systems.
Figure 6:
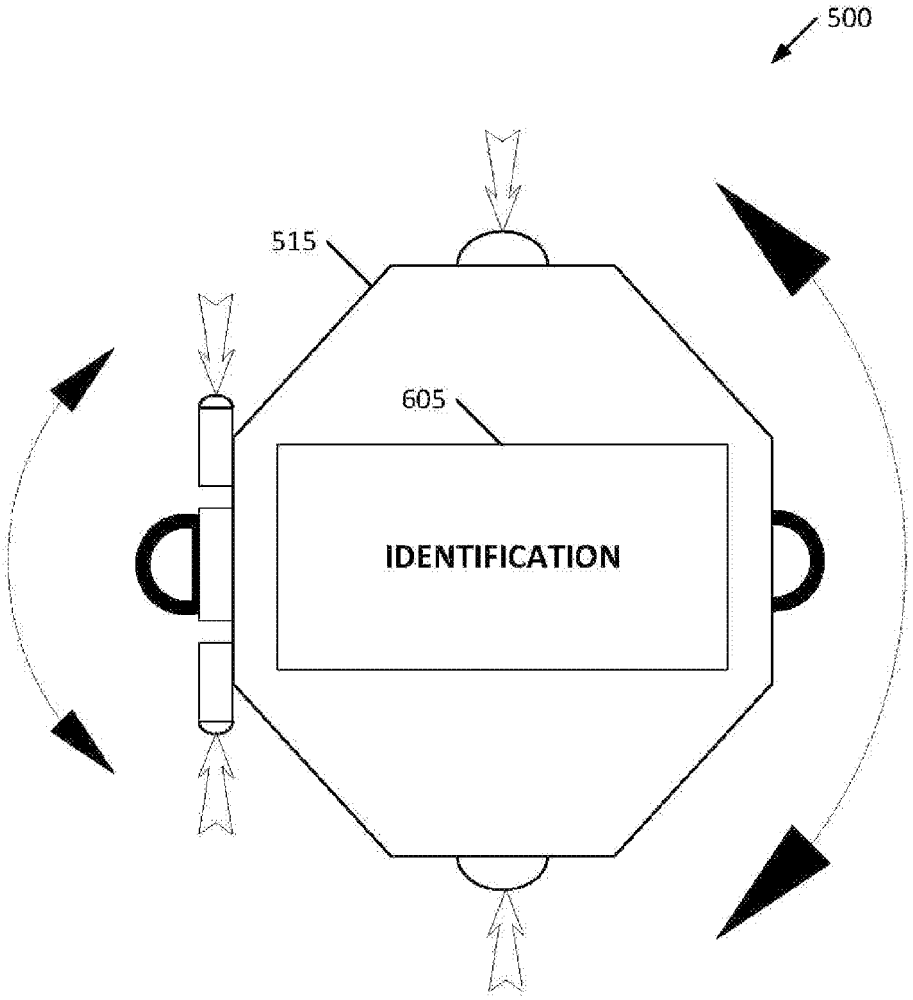
FIG. 6 illustrates a bottom view of the jewelry object shown in FIG. 5.

FIG. 5 illustrates a top view of a jewelry object 500 having a pair of independently-operable engagement systems (i.e., a first engagement system 505 and a second engagement system 510), and FIG. 6 illustrates a bottom view of jewelry object 500. Jewelry object 500 may be configured as described herein with reference to clasp 10 shown in FIG. 1-FIG. 4 including a housing 515 (e.g., female member 12) and an interlocking member 520 (e.g., male member 14). First engagement system 505 includes a specially designed structure (e.g., slot 28 between first end 24 and second end 26 of sidewall 20) as part of jewelry object 500. Second engagement system 510 includes a specially designed structure 525 (e.g., legs 18, each operated by a foot 34) as part of jewelry object 500. The engagement systems of housing 515 are designed to interface to interlocking member 520 (e.g., male member 14). Interlocking member 520 includes a pair of complementary engagement structures (i.e., a first engagement structure (not shown—corresponding to, for example, head 70 and neck 72 with shoulder 74 therebetween) and a second engagement structure 530 (e.g., tabs 68). A chain, cord, or other retaining system or the like is attached to a pair of attachment points, a first attachment point 535 attached to housing 515 and a second attachment point 540 attached to interlocking member 520.

Each engagement system has a corresponding engagement structure, with interlocking member 520 transitioning between a closed mode and an open mode. FIG. 5 illustrates jewelry object 500 with interlocking member 520 in the closed mode. In the closed mode, interlocking member 520 is secured to housing 515, and a chain having a first end attached to first attachment point 535 and having a second end attached to second attachment point 540 results in a closed loop that remains closed until and unless interlocking member 520 transitions to the open mode and is released from housing 515. In the open mode, there is no closed loop and jewelry object 500 may be associated with a limb (arm/wrist) or appendage (neck) and then closed about the limb or appendage by engaging the engagement structures with the engagement systems.

To transition jewelry object 500 from the closed mode to the open mode, such as for example, to remove jewelry object 500 from around the wrist or neck, both pair of independently-operable engagement systems must be actuated substantially simultaneously/concurrently. Actuating either one or the other by itself does not permit interlocking member 520 to be released from housing 515. In the preferred embodiment, actuation of first engagement system 505 is shown as depressing a pair of engagement structures (an application of a force F1 to each of structures 530), and actuation of second engagement system 510 is shown as depressing a pair of engagement structures (an application of a force F2 to each of structures 525). Forces F1 may be applied by a thumb and an index finger of a first hand and forces F2 may be applied by a thumb and index finger of a second hand. Once sufficient forces F1 and forces F2 are applied, separation of the hands results in release of interlocking member 520 from housing 515 (transition to the open mode).

For a necklace configured as jewelry object 500, it is possible for a single person wearing the necklace to use both of their hands to operate and manipulate the pair of independently-operable engagement systems. However, for a bracelet configured as jewelry object 500, it is not possible for a single person wearing the bracelet to operate and manipulate the pair of independently-operable engagement systems. This is because only one hand of the wearer is available due to the fact that the hand attached to the wrist wearing the bracelet cannot reach housing 515 or interlocking member 520. With only one hand available, the bracelet cannot be removed because the pair of independently-operable engagement systems cannot be substantially simultaneously/concurrently operated. The present invention contemplates other types and arrangements of independently-operable engagement systems and structures in addition to those described herein.

Back of housing 515 includes an identification plate 605. Identification plate 605 may be affixed with different types of information, dependent upon the implementation, to help a caregiver caring for a person wearing jewelry object 500. In bracelet format, jewelry object 500 helps to ensure that the desired information to help the caregiver in caring for the wearer is associated with the wearer because the wearer is unable to remove jewelry object 500 without assistance. Without assistance, jewelry object 500 remains affixed and the information of information plate 605 is available to every caregiver having need of the information. The same is true of other features and attributes of jewelry object 500, such as inclusion of the global satellite positioning system described herein, for locating the wearer. This is important for wearers who may otherwise remove conventional identification systems from their person and who would be at a disadvantage in helping a caregiver care for the wearer's needs.

While the preceding describe the clasp and closure system as preferably integrated into a jewelry object in general, and more particularly in a bracelet, the present invention is not so limited as other closure systems and objects benefit from the teachings herein.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention.

What is claimed as new and desired to be protected by Letters Patent of the United States is:

1. A closure system of a portable, removeably semi-permanently associatable article of manufacture configured to be worn by a wearer, comprising:

a male member including a central body disposed between a distal end and a proximal end along a longitudinal axis, said distal end having a distal shoulder formed on a first projection from said central body wherein said distal shoulder is selectively movable between a relaxed position and a compressed position and said proximal end having a proximal shoulder on a second projection from said central body wherein said proximal shoulder is selectively movable between a relaxed position and a compressed position by operation of a shoulder extension; and a female member having a wall defining an interior chamber and a slot configured within a slot portion of said wall to receive said male member into said interior chamber, said female member including a post disposed within said interior chamber configured to engage and capture said distal shoulder within said interior chamber after said male member is received within said interior chamber and a finger, independent from said male member, moveably coupled through a lateral portion of said wall configured to operate said distal end between said relaxed position and said compressed position, said finger including an outside extending portion and an inside extending portion coupled to said outside extending portion, and wherein said slot portion includes a ledge configured to engage said proximal shoulder when both said male member is received into said interior chamber and said post engages and captures said distal shoulder; and wherein said male member is inhibited from withdrawal from said interior chamber while either of said ends are in said relaxed mode; and wherein said male member is enabled for withdrawal from said interior chamber while both of said ends are in said compressed mode responsive to independent actuation of said finger and said shoulder extension.

2. The closure system of claim 1 wherein said outside extending portion includes a first actuating end extending a first distance from said longitudinal axis; and wherein said shoulder extension includes a second actuating end extending a second distance from said longitudinal axis different from said first distance and configured so that a single hand of the wearer cannot operate both said actuating ends.

3. A closure system of a portable, removeably semi-permanently associatable article of manufacture configured to be worn by a wearer, comprising:

a female member having a wall defining an interior chamber and a slot configured within a slot portion of said wall and adapted to receive a means for engagement into said interior chamber, said female member including a post disposed within said interior chamber and a finger moveably coupled through a lateral portion of said wall, said finger including an outside extending portion and an inside extending portion coupled to said outside extending portion, and wherein said slot portion defines a ledge; and wherein said engagement means is for independent selective releasable engagement of said post and said ledge and is configured to be inoperable using one hand of said wearer for simultaneous release of said ledge and said post.

* * * * *